US006035614A

United States Patent [19]

Gustafsson et al.

[11] Patent Number: 6,035,614

[45] Date of Patent: Mar. 14, 2000

[54] FILLING PIPE FOR LIQUID FOOD PACKAGING MACHINES

[75] Inventors: Per Gustafsson, Bjarred, Sweden; Paolo Fontanazzi, Modena, Italy

[73] Assignee: Tetra Laval Holdings & Finance S.A., Pully, Switzerland

[21] Appl. No.: 09/090,412

[22] Filed: Jun. 4, 1998

[30] Foreign Application Priority Data

Jun. 4, 1997 [EP] European Pat. Off. ..... 97109019

[51] Int. Cl.[7] ..... B65B 9/06

[52] U.S. Cl. ..... 53/551

[58] Field of Search ..... 53/58, 503, 504, 53/552, 551, 550

[56] References Cited

U.S. PATENT DOCUMENTS

| | | | |
|---|---|---|---|
| 2,687,740 | 8/1954 | Järund . | |
| 2,869,299 | 1/1959 | Järund . | |
| 3,331,902 | 7/1967 | Stark . | |
| 3,457,968 | 7/1969 | Tuma . | |
| 3,470,672 | 10/1969 | Tuma . | |
| 3,526,079 | 9/1970 | Maxeiner et al. | 53/551 |
| 3,911,642 | 10/1975 | Ernstsson et al. . | |
| 3,912,535 | 10/1975 | Rausér . | |
| 3,970,426 | 7/1976 | Stark et al. . | |
| 4,099,914 | 7/1978 | Gustafsson et al. . | |
| 4,218,265 | 8/1980 | Fuchs et al. . | |
| 4,225,556 | 9/1980 | Löthman et al. . | |
| 4,243,160 | 1/1981 | Reil . | |
| 4,606,174 | 8/1986 | Berg . | |
| 4,608,810 | 9/1986 | Bordini . | |
| 4,617,779 | 10/1986 | Nygren et al. . | |
| 4,641,486 | 2/1987 | Zannoni . | |
| 4,784,697 | 11/1988 | Bordini . | |
| 4,809,485 | 3/1989 | Nielsen . | |
| 4,984,601 | 1/1991 | Andersson et al. . | |
| 5,044,104 | 9/1991 | Iwano et al. | 53/551 |
| 5,335,479 | 8/1994 | Lemke et al. | 53/551 |
| 5,463,851 | 11/1995 | Nagai | 53/552 |
| 5,546,733 | 8/1996 | Paltrinieri . | |

FOREIGN PATENT DOCUMENTS

| | | |
|---|---|---|
| 3224544 | 1/1989 | Germany . |

*Primary Examiner*—Linda Johnson
*Attorney, Agent, or Firm*—Burns, Doane, Swecker & Mathis, L.L.P.

[57] ABSTRACT

The improved filling pipe (1) is for use in liquid food packaging machines of the type wherein a longitudinally-sealed continuous tubular container (2) is formed from a web (3) of packaging material, and members successively clamp the tube at regularly spaced intervals for forming and transversely sealing packages filled with product. The filling pipe (1) is locatable axially of the continuous tubular container and has a rigid damper member (4) affixed to and surrounding a portion of the filling pipe (1). The rigid damper member (4) is locatable at a position which is radially spaced from the inner wall **(2*a*) of a continuous tubular container (2) and entraps an air pocket (5) surrounding a portion of the filling pipe (1) for dampening motion of liquid product (20) relative to the filling pipe (1) in a packaging material tube (1)** during operation of a liquid food packaging machine.

6 Claims, 3 Drawing Sheets

FILLING PIPE FOR LIQUID FOOD PACKAGING MACHINES

TECHNICAL FIELD

The present invention relates to an improved product filling pipe for machines of the type used for packaging liquid or pourable food products, including wine, milk, tomato puree, edible oils, fruit juices, cream, water, tea, mayonnaise etc., and including sterile treated products such as U.H.T milk, which is subjected to ultra high temperature thermal treatment. The product filling pipe according to the present invention can be used in machines for forming, filling and sealing aseptic packages of liquid food products, or in machines for forming, filling and sealing packages of pasteurized liquid food products.

BACKGROUND ART

One common type of packaging for the above types of liquid or pourable food products is a container made from a blank or a continuous web of laminated packaging material constituted by a layer of fibre-based material such as paper, which is covered on each side with a plastics material such as polyethylene. In order to manufacture aseptic packages, one face of the polyethylene coated paperboard is coated with a barrier material such as aluminum or a synthetic barrier material, which in turn is coated with a plastics material. For manufacturing aseptic packages, the web of packaging material passes through an aseptic chamber and is sterilized, for example by means of the application of a sterilizing agent such as hydrogen peroxide which is successively evaporated by heating and/or by irradiating the packaging material with light of appropriate wavelength and intensity. The sterilized web of laminated packaging material is bent and longitudinally sealed to form a packaging material tube. The packaging material tube in practice forms an extension of the aseptic chamber and is continuously filled with sterile or sterile treated liquid food product.

The longitudinally sealed tube filled with liquid food product is then clamped between pairs of forming and sealing members which transversely seal and form the product filled tube to form pillow-shaped packages. The forming and sealing members may be mounted in mutually facing pairs, on respective pairs of continuously-moving mutually-facing chains having opposite directions of rotation, whereby to form and seal the packages therebetween. One known type of machine of this kind is disclosed in U.S. Pat. No. 3,300,944. Alternatively, the forming and sealing members may be mounted on pairs of reciprocating jaws. One example of this kind of machine is the TBA/19 machine manufactured by Tetra Brik Packaging Systems of Via Delfini 1, 41100 Modena, Italy. The filled and sealed pillow-shaped packages are then transported to a final folding station, wherein the pillow-shaped packages are mechanically folded into a final shape, such as a parallelepiped shape. One example of commercially available packages of this type are the parallelepiped packages commonly known by the registered trademark "Tetra Brik Aseptic".

While the above mentioned types of machine are excellent from many standpoints, they have been found to be susceptible to improvements with respect to the mechanism for filling the tube of laminated packaging material with product. Different solutions have been proposed for solving the technical problem of how to control of the level of product in the packaging material tube, to ensure correct functioning of the machine, even at high speeds and also with an ever-increasing range of products of varying characteristics, such as viscosity, susceptibility to foaming etc.

Known from U.S. Pat. No. 3,470,672 is an apparatus for packaging viscous liquid materials which includes means for forming a longitudinally-sealed continuous tubular container from a web of packaging material, a filler pipe disposed axially of the tubular container for introducing liquid material therein, and members for successively clamping the tube at regularly spaced intervals for forming and transversely sealing packages filled with product. A flexible bell-shaped member of resilient flexible material is secured about the filling pipe, and the circumferential skirt of the bell-shaped member slidingly and sealingly engages the inner wall of the of the tubular container to form a closed space defined by the inside of the bell-shaped member and the level of the viscous liquid above the bottom edge of the skirt. The thickness of the bell-shaped member diminishes towards the lower edge thereof, to improve the sliding and sealing engagement with the inner wall of the tubular container. Means responsive to pressure are provided in the closed space for controlling the rate of introduction on viscous liquid through the filler pipe. The flexible bell-shaped member is provided with vents to permit the escape of air bubbles introduced with the viscous liquid into the closed space. While this system provided a greater degree of control of viscous liquids, it could not be used to facilitate product level control in modern high-speed liquid food packaging machines. In fact the requirement for sliding sealing engagement between the inside of the packaging material tube and the bell-shaped member, would prejudice the integrity of the packaging material, cause excessive wear of the bell-shaped member and imply a risk of contaminating the liquid food product with residues of the material constituting the bell-shaped member through friction generated at the inner wall of the packaging material tube.

Another known type of product level control mechanism includes a product filling pipe having an end portion located axially within the packaging material tube. The end portion of the filling pipe has a downwardly open end which is immersed in the product contained in the packaging material tube. A float member is slideably connected to the filling pipe and is in turn connected to a butterfly valve located within the filling pipe. The float member is connected to the butterfly valve by a kinematic mechanism, which causes the butterfly valve to throttle the filling pipe when the float rises above a predetermined level and opens the valve when the float falls below such level. Thus, every time that the longitudinally sealed tube of packaging material is clamped by the forming and sealing members, the product level rises in the packaging material tube, thereby causing the float to rise and the butterfly valve to throttle the filling pipe, thereby slowing down the product flow into the packaging material tube. The continuous movement of the packaging material tube then causes the product level to drop, thereby causing the level of the float member to fall, with consequent opening of the butterfly valve for increasing the rate of filling of the product tube, ready for being clamped again by the forming and sealing members. This cycle is repeated continuously during the normal operation of the machine and the level of the product within the packaging material tube oscillates continuously.

As the speed of the machines for packaging pourable food products has increased, so has the range of products which these machines are used for packaging. There is thus a wider range of viscosities to cope with, as well as a wider range of degrees of susceptibility to foaming. This adds to the problem of how to control the product level in the packaging material tube. The product level must be controlled in a manner which has sufficiently rapid response times to cope with the rapidly fluctuating product level and with products of different characteristics. Furthermore, such systems must withstand high working temperatures, and be capable of being cleaned and disinfected with chemical agents at high temperatures.

Flow-control valves, located on the product line in a position remote from the end portion of the filling pipe, have been used as an alternative to the above-cited butterfly valves for controlling the rate of flow of the product through the filling pipe. The flow-control valve may be controlled by one or more sensors. The known sensors are either located externally of the packaging material tube for detecting the position of a detectable float which indicates the product level within the packaging material tube, or on the filling pipe for directly contacting and thereby detecting the presence of product within the longitudinally sealed packaging material tube at a predetermined level. In this case, each time that the sensor either directly contacts the product at a predetermined location on the filling pipe, or each time that the position of a detectable float is detected at a predetermined product level, a signal is generated which indicates that the required product level has been reached for permitting correct functioning of the liquid food packaging machine and the valve automatically controls the flow of product through the filling pipe and into the packaging material tube. The flow rate varies continuously. Each time that the packaging material tube is gripped between the pairs of package forming and sealing members and the product level rises in the tube, the sensor-controlled valve automatically throttles the flow of product through the filling pipe to reduce the product flow rate. The continuous movement of the packaging material tube then causes the product level to drop, and when the sensor is no longer contacted by the product or no longer senses the float at the predetermined position, a signal is generated which causes the valve to automatically open and increases the product flow rate.

Although these latter systems afford a smoother control of the product flow when compared to the butterfly valves, problems have been encountered when using these filling systems, particularly in chain-type machines (as disclosed e.g., in the above-mentioned U.S. Pat. No. 3,300,944) for packaging liquid food products, and especially when such chain-type machines operate at high-speed.

It has been found that when operating at very high speeds, i.e., when operating liquid food packaging machines at a production rate of 18000–24000 packages per hour, additional problems arise relating to the control of the product level in the packaging material tube, due to the fact that between successive package filling, forming and sealing operations performed by the forming and sealing members, there is not sufficient time for the product level to fall significantly by gravity. Low pressures are in fact generated within the packaging material tube during the package forming cycle, caused by the dynamics of the liquid food product inside the tube. Such low pressures can adversely affect the formation of the continuous longitudinally sealed tube with the packaging material web.

OBJECTS OF THE INVENTION

An object of the invention is to provide an improved product filling pipe for machines for packaging liquid food products of the type having means for forming a continuous longitudinally-sealed tubular container from a web of packaging material, which improves formation of the packaging material tube by avoiding creating underpressures in the package forming zone, even when the machine operates at high speed and without thereby requiring any overpressure above the product level to ensure correct formation of the packaging material tube.

Another object of the invention is to provide an improved product filling pipe for liquid food packaging machines which can be arranged axially in a continuous longitudinally-sealed packaging material tube, which does not require any sealing sliding engagement with the packaging material tube, thereby eliminating problems relating to wear and deterioration of mutually sliding members, and preventing any risk of contaminating the product with residues of material which would otherwise be caused by friction generated by such sliding sealing engagement.

A further object of the invention is to provide an improved product filling pipe for liquid food packaging machines which avoids underpressures in the package forming zone and which effectively dampens the effect of changes in product level in a packaging material tube, even when used in high-speed liquid food packaging machines operating at production rates of up to 18000–24000 packages per hour, i.e., in situations wherein the product level fluctuates continuously and without sufficient time elapsing between the formation of successive packages for the product level to fall by gravity.

Another object of the invention is to provide an improved product filling pipe for liquid food packaging machines, which is structurally simple and extremely reliable in operation.

DISCLOSURE OF THE INVENTION

With the above-mentioned objects in view, the invention provides a product filling pipe for liquid food packaging machines of the type including means for forming a longitudinally-sealed continuous tubular container from a web of packaging material, and members for successively clamping the tube at regularly spaced intervals for forming and transversely sealing packages filled with product, said filler pipe being locatable axially of the tubular container for introducing liquid material therein, characterized in that it comprises a rigid damper member affixed to and surrounding at least a portion of said filling pipe, said rigid damper member entrapping an air pocket surrounding said filling pipe for dampening motion of liquid product relative to said filling pipe in a packaging material tube during operation of a liquid food packaging machine.

According to another aspect of the invention, the invention provides, a liquid food packaging machine of the type including means for forming a longitudinally-sealed continuous tubular container from a web of packaging material, a filler pipe disposed axially of the tubular container for introducing liquid food product therein, means for controlling the rate of introduction of a liquid food product into said longitudinally-sealed continuous tubular container through said filler pipe, and members for successively clamping the tube at regularly spaced intervals for forming and transversely sealing packages filled with the liquid food product, characterized in that it comprises a rigid damping member affixed to and surrounding at least a portion of said filling pipe and entrapping an air pocket surrounding said filling pipe for dampening motion of liquid product relative to said filling pipe in said packaging material tube during operation of said liquid food packaging machine.

DESCRIPTION OF THE PREFERRED EMBODIMENTS

Figure 1:
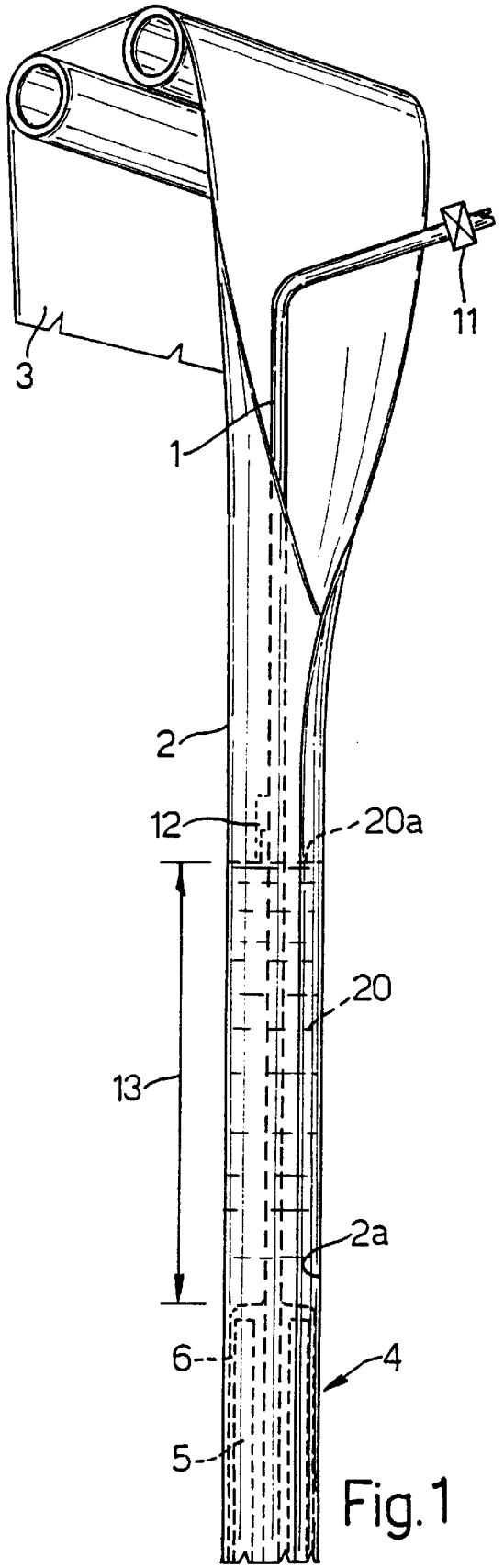
FIG. 1 is a schematic perspective view illustrating a longitudinally-sealed continuous tubular container made from a paper web in a liquid food packaging machine, showing the location therein, of the filling pipe according to the invention.
Figure 2:
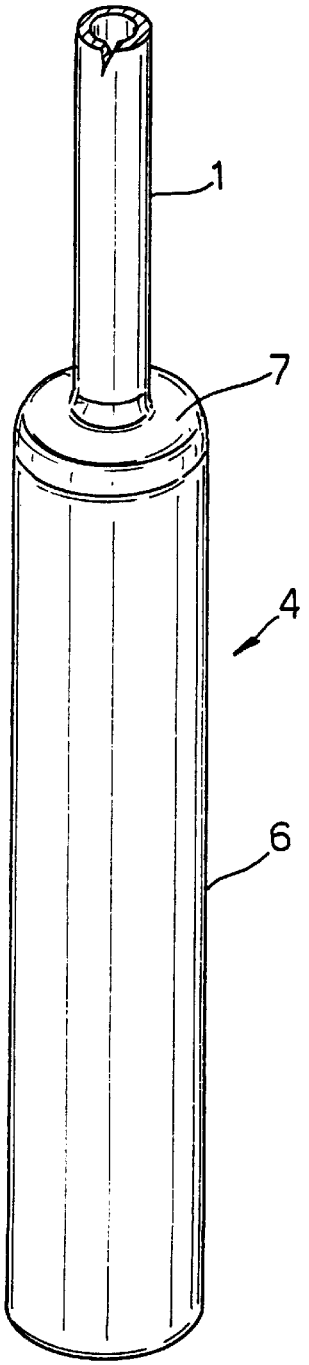
FIG. 2 is a perspective view, of the rigid damping member of the filling pipe according to the invention.
Figure 3:
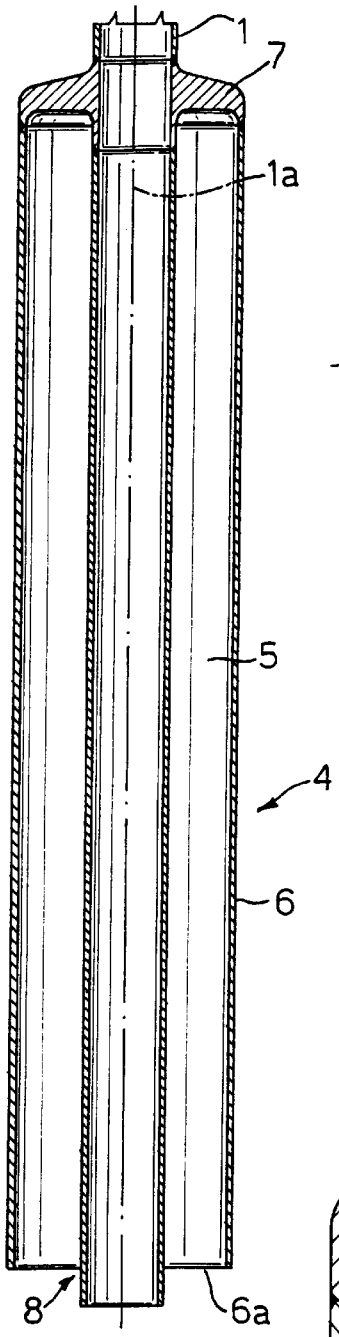
FIG. 3 is a larger-scale cross-sectional view of the rigid damper member of the filling pipe according to the invention, taken along the longitudinal axis thereof.

With reference to the above described drawing figures, the reference numeral 1 indicates a filling pipe for liquid food packaging machines of the type including conventional means for forming a longitudinally-sealed continuous tubular container 2 from a web 3 of packaging material, and members for successively clamping the tubular container 2 at regularly spaced intervals for forming and transversely sealing packages filled with product. The members for successively clamping the tube do not constitute part of the present invention and thus will not be described herein.

As shown in FIG. 1, the filler pipe 1, in use, is located axially of the tubular container 2 for introducing liquid food product into the container. In accordance with the present invention, a rigid damper member 4 is fixed to the filling pipe 1 and surrounds a portion of the filling pipe 1. The rigid damper member 4 is located at a position which is spaced radially inwards from the inner surface 2*a* of the packaging material tube 2 and entraps an air pocket 5 surrounding the filling pipe 1. In practice, this has the effect of dampening motion of liquid product 20 contained in the packaging material tube 2 relative to the filling pipe 1 during operation of a liquid food packaging machine. As clearly shown in the drawing FIGS. 1–4, the rigid damper member 4 has an elongate configuration and comprises an annular flange 7 extending around the filling pipe 1. The annular flange 7 extends substantially perpendicularly with respect to the annular wall 6 of the rigid damping member 4 and the axis 1*a* of the filling pipe 1. The annular wall 6 protrudes from the annular flange 6 and extends parallel to the filling pipe 1 for a distance which is greater than the overall diameter of the rigid damper member 4, and preferably for a distance which is at least two-times greater than the overall diameter of the rigid damping member 4. The bottom edge of the annular wall 6 defines the lower annular edge 6*a* of the rigid damper member 4, and the filling pipe 1 has an end portion 8 extending beyond the lower annular edge 6*a*.

Figure 7:
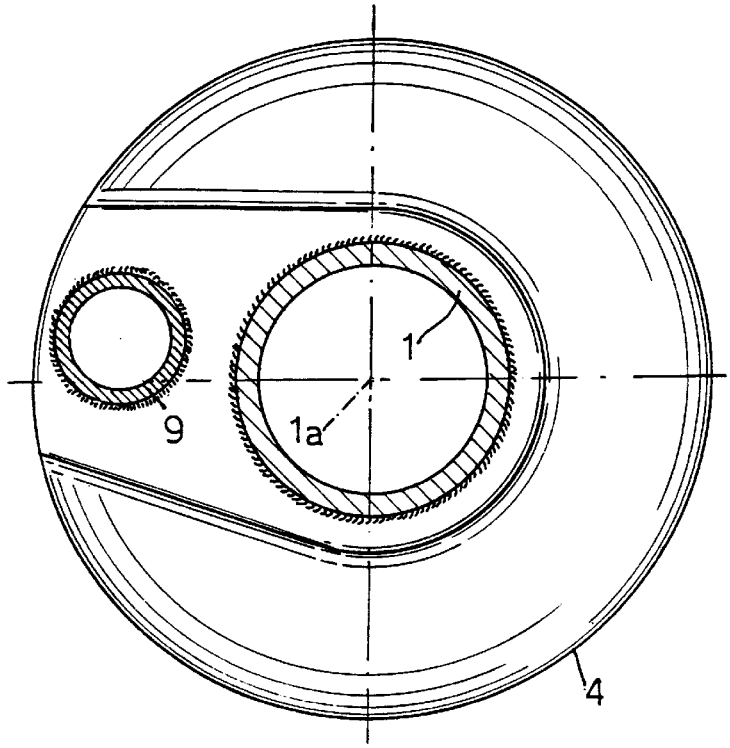
FIG. 7 is an enlarged top plan view of the filling pipe of FIGS. 5 and 6.
Figure 4:
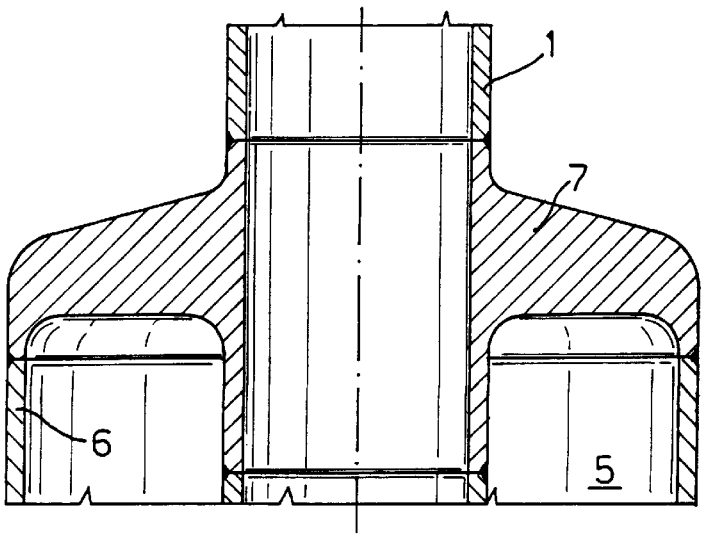
FIG. 4 is an enlarged cross-sectional view showing the connection of the damping member to the filling pipe.
Figure 5:
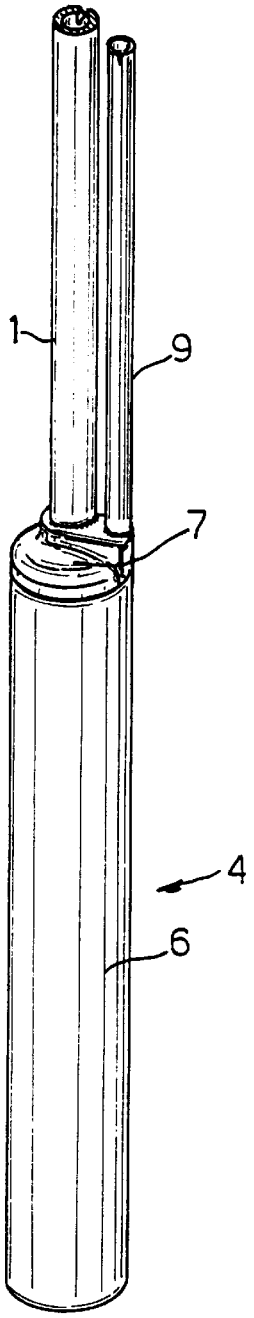
FIG. 5 is a perspective view of a second embodiment of the filling pipe according to the invention, including a damping member provided with an auxiliary service conduit.
Figure 6:
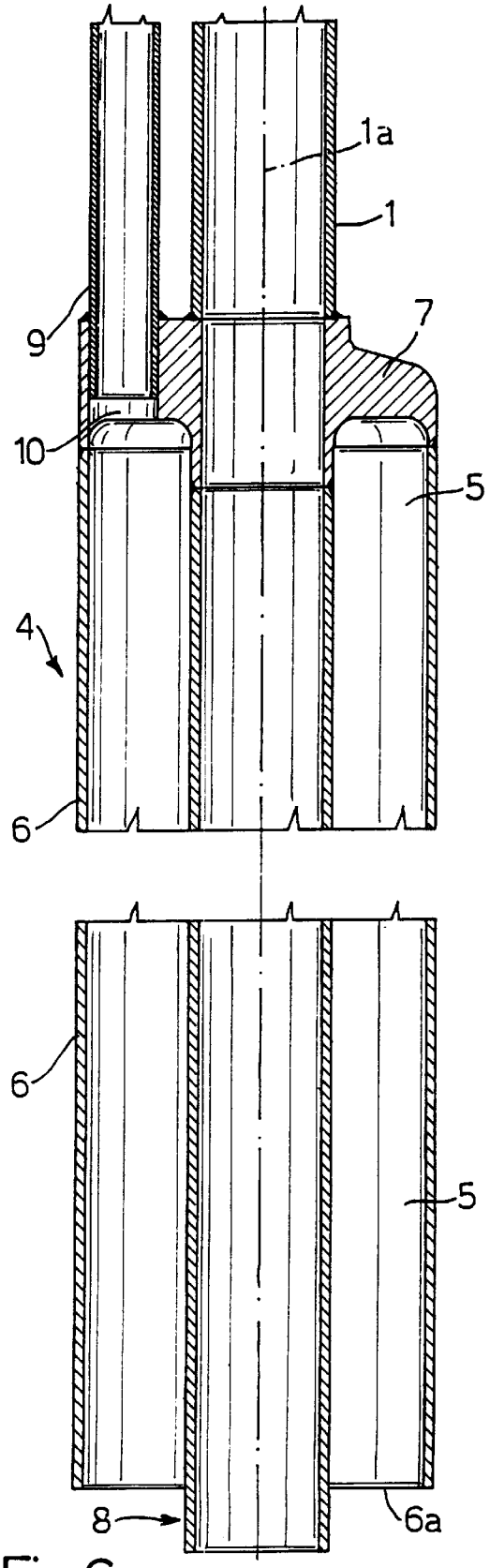
FIG. 6 is an enlarged-scale cross-sectional view showing the rigid damper member and the auxiliary service conduit of the filling pipe of FIG. 5, taken along a plane passing through the longitudinal axes of the filling pipe and the auxiliary service conduit.

Drawing FIGS. 5–7 illustrate a second embodiment of the invention, wherein equivalent parts are identified with the same reference numerals as those of the first embodiment described heretofore. Also the filling pipe 1 of this second embodiment of the invention has connected thereto a rigid damper member 4 which, in use, is located at a position which is spaced radially inwards from the inner surface 2*a* of the packaging material tube 2 and entraps an air pocket 5 surrounding the filling pipe 1, for dampening motion of liquid product 20 contained in the packaging material tube 2 relative to the filling pipe 1 during operation of a liquid food packaging machine. An annular wall 6 protrudes from the annular flange 7 and extends parallel to the filling pipe 1, which has an end portion 8 extending beyond the lower annular edge 6*a*.

According to this second embodiment of the invention, the filling pipe comprises an auxiliary service conduit 9 communicating with the air pocket 5 in the rigid damping member 4, and connectable to a sterilizing medium source, for permitting the introduction of sterilizing medium into said rigid damper member 4. The auxiliary service conduit 9 may also be connected to a source of sterile air for replenishing any air in the pocket 5 which may be lost during operation of the liquid food packaging machine. The auxiliary service conduit extends substantially parallel to the filling pipe 1 and communicates with the air pocket 5 in the damper member 4 through a hole 10 extending through the annular flange 7 at a location between the filling pipe 1 and the annular wall 6 of the rigid damping member 4.

The relevant parts of a known machine for packaging liquid food products will now be described for better understanding of the filling pipe according to the invention. As known, one type of liquid food packaging machine has conventional means (not illustrated) for forming a longitudinally-sealed continuous tubular container 2 from a web 3 of packaging material (see FIG. 1). The filler pipe 1 is disposed axially of the tubular container 2 for introducing a liquid food product 20 therein. A conventional flow control valve 11 is provided on the filling pipe 1 for controlling the rate of introduction of a liquid food product into the longitudinally-sealed continuous tubular container 2. The valve 11 is controlled in a known manner by a sensor 12, located adjacent the filling pipe 1 inside the tubular container 2. Conventional clamping members or package forming and sealing members (not illustrated) are provided for successively clamping the tube at regularly spaced intervals for forming and transversely sealing packages filled with liquid food product.

Each time that the packaging material tube 2 is gripped between the pairs of package forming and sealing members the product level 20*a* rises in the tube 2. The liquid food product 20 thereby comes into contact with the sensor 12, and the sensor generates a signal which is transmitted to the valve 11, which, in a known manner, automatically throttles the flow of product through the filling pipe to reduce the product flow rate. The continuous movement of the packaging material tube 2 then causes the product level 20*a* to drop, and when the sensor 12 is no longer contacted by the product 20, the valve 11 automatically opens and increases the product flow rate. Between successive package filling, forming and sealing operations performed by the forming and sealing members in high-speed liquid food packaging machines, there is not sufficient time for the product level 20*a* to fall significantly by gravity. Advantageously, the sensor 12 is positioned to form a column of liquid food product in the longitudinally-sealed continuous tubular container 2, whereby to exert a pressure of from 0.03 to 0.3 bar on the damper member 4, and preferably to exert a pressure of 0.1 bar thereon.

The rigid damper member of the filling pipe according to the invention has an air pocket 5 surrounding the filling pipe 1. In this manner, the damper member 4 compensates the low pressures generated within the packaging material tube during the package forming cycle, caused by the dynamics of the liquid food product inside the continuous tubular container. In practice, the damper member 4 forms a dynamic seal in the continuous tubular container 2. During the package forming cycle, the product 20 contained in the continuous tubular container 2 is forced upwardly and downwardly around the damper member 4, through the gap between the outside of the damper member 4 and the inside surface 2*a* of the tubular container 2. The flow of product 20 around the damper member 4 is significantly smaller than the flow in and out of the damper member. However, the velocity of the flow of liquid product 20 around the damper member 4 can be high, but in practice this does not cause any splashing effects above the damper member, because potential splashing effects are contained in the liquid column 13 above the damper member 4. This has the very important advantage of avoiding underpressure in the package forming zone of a liquid food packaging machine, and also has the advantageous effect of creating very little movement of the level 20*a* of the liquid product 20 above the damper member 4. It has been found that this advantageously ensures correct formation of the continuous tubular container 2 with the packaging material web 3, even at production rates of up to 18000–24000 packages per hour.

Advantageously, the outer surface of the damper member 4 is spaced radially from the inner surface 2*a* of the longitudinally-sealed continuous tubular container 2 by a distance of from 0.1 mm to 10 mm, preferably from 0.5 mm to 10 mm, and more preferably by a distance of about 1 mm. This prevents any sliding contact engagement from occurring between the damper member 4 and the continuous tubular container 2, thereby eliminating problems relating to wear and deterioration of mutually sliding members, and preventing any risk of contaminating the liquid food product 20 with residues of material which would otherwise be caused by friction.

The invention as described herein may be modified without departing from the purview of the appended claims.

What is claimed is:

1. In combination, a liquid food packaging machine and a rigid damping member, said liquid food packaging machine comprising;

means for forming a longitudinally-sealed continuous tubular container from a web of packaging material;

a filling pipe disposed axially of the tubular container for introducing a liquid food product therein, said filling pipe having a lower portion for immersion in a liquid food product;

means for controlling the rate of introduction of a liquid food product into said longitudinally-sealed continuous tubular container through said filling pipe;

members for successively clamping said longitudinally-sealed continuous tubular container at regularly-spaced intervals for forming and transversely sealing packages filled with liquid food product;

wherein said rigid damping member comprises an annular flange connected to and extending around said lower portion of said filling pipe;

an annular wall rigidly connected to said annular flange, said annular wall extending from said annular flange substantially parallel to said lower portion of said filling pipe and being spaced from said longitudinally-sealed continuous tubular container; and an air pocket contained within said damping member and surrounding said lower portion of said filling pipe, whereby when liquid food product flows through said filling pipe and into said tubular container, said damping member dampens the motion of said liquid food product relative to said filling pipe within said longitudinally-sealed continuous tubular container.

2. A liquid food packaging machine according to claim 1, wherein said rigid damper member has an outer surface which is spaced radially inwardly from the inner surface of said longitudinally-sealed continuous tubular container.

3. A liquid food packaging machine according to claim 2, wherein said outer surface of said damper member is spaced radially from the inner surface of said longitudinally-sealed continuous tubular container by a distance of from 0.1 mm to 10 mm.

4. A liquid food packaging machine according to claim 3, wherein said outer surface of said damper member is spaced radially from the inner surface of said longitudinally-sealed continuous tubular container by a distance of about 1 mm.

5. A liquid food packaging machine according to claim 2, wherein said means for controlling the rate of introduction of a liquid food product comprise sensor means located adjacent said filler pipe for detecting the level of liquid food product in said longitudinally-sealed continuous tubular container, valve means activated by said sensor means for controlling the flow of liquid food product through said filler pipe to maintain a head of liquid food product in said longitudinally-sealed continuous tubular container, wherein said sensor means are positioned to form a column of liquid food product in said longitudinally-sealed continuous tubular container exerting a pressure of from 0.03 to 0.3 bar on said damper member.

6. A liquid food packaging machine according to claim 5, wherein said sensor means are positioned to form a column of liquid food product in said longitudinally-sealed continuous tubular container exerting a pressure of about 0.1 bar on said damper member.

* * * * *